US005130012A

United States Patent [19]

Edwards et al.

[11] Patent Number: 5,130,012

[45] Date of Patent: Jul. 14, 1992

[54] PROCESS AND APPARATUS FOR REDUCING $NO_x$ EMISSIONS FROM HIGH-EFFICIENCY FFC REGENERATORS

[75] Inventors: Michael S. Edwards, West Deptford; David A. Land, Marlton, both of N.J.; Catherine L. Markham, Glen Mills; Joseph R. Misiewicz, Aston, both of Pa.; John P. Schields, Voorhees, N.J.

[73] Assignee: Mobil Oil Corporation, Fairfax, Va.

[21] Appl. No.: 645,168

[22] Filed: Jan. 24, 1991

[51] Int. Cl.[5] ..... C10G 11/00

[52] U.S. Cl. ..... 208/113; 208/164; 502/40; 502/41; 502/42; 502/43; 422/144

[58] Field of Search ..... 208/113, 164; 502/40, 502/41, 42, 43; 422/83, 144

[56] References Cited

U.S. PATENT DOCUMENTS

| | | | |
|---|---|---|---|
| 4,093,537 | 6/1978 | Gross et al. | 208/164 |
| 4,162,213 | 7/1979 | Zrinscak, Sr. et al. | 208/113 |
| 4,235,704 | 11/1980 | Luckenbach | 502/42 X |
| 4,578,366 | 3/1986 | Cetinkaya et al. | 502/6 |
| 4,812,430 | 3/1989 | Child | 502/42 |
| 4,868,144 | 9/1989 | Herbst et al. | 502/43 |

*Primary Examiner*—Theodore Morris
*Assistant Examiner*—William C. Diemler
*Attorney, Agent, or Firm*—Alexander J. McKillop; Charles J. Speciale; Richard D. Stone

[57] ABSTRACT

A fluidized catalytic cracking process using a high efficiency regenerator comprising a coke combustor, a dilute phase transport riser, and a second fluidized bed with catalyst recirculation to the coke combustor, is operated to reduce $NO_x$ emissions in the regenerator flue gas. The amount of catalyst recirculation from the second fluidized bed to the coke combustor or combustion air addition or preferably both are adjusted based on continuous or periodic measurement of a process parameter of the FCC regenerator which directly or indirectly measures the $NO_x$ content of regenerator flue gas. Operation with restricted air or catalyst recirculation degrades coke combustor operation, shifts some regeneration to downstream portions of the regenerator, and reduces $NO_x$ emissions.

4 Claims, 3 Drawing Sheets

PROCESS AND APPARATUS FOR REDUCING $NO_x$ EMISSIONS FROM HIGH-EFFICIENCY FFC REGENERATORS

BACKGROUND OF THE INVENTION

1. Field of the Invention

The invention relates to catalytic reduction of oxides of nitrogen, $NO_x$, produced in the FCC regenerators.

2. Description of Related Art

The presence of $NO_x$, or oxides of nitrogen, in flue gas is a pervasive problem. Several powerful ways have been developed to deal with the problem. The approaches fall into roughly three categories, process approaches which inherently reduce the amount of $NO_x$ formed in a regenerator, catalytic approaches using a catalyst or additive which is compatible with the FCC reactor, and stack gas cleanup methods which are isolated from the FCC process. The FCC process will be briefly reviewed, followed by a review of the state of the art in reducing $NO_x$ emissions.

FCC PROCESS

Catalytic cracking of hydrocarbons is carried out in the absence of externally supplied H2, in contrast to hydrocracking, in which H2 is added during the cracking step. An inventory of particulate catalyst is continuously cycled between a cracking reactor and a catalyst regenerator. In the fluidized catalytic cracking (FCC) process, hydrocarbon feed contacts catalyst in a reactor at 425° C.-600° C., usually 460° C.-560° C. The hydrocarbons crack, and deposit carbonaceous hydrocarbons or coke on the catalyst. The cracked products are separated from the coked catalyst. The coked catalyst is stripped of volatiles, usually with steam, and is then regenerated. In the catalyst regenerator, the coke is burned from the catalyst with oxygen containing gas, usually air. Coke burns off, restoring catalyst activity and simultaneously heating the catalyst to, e.g., 500° C.-900° C., usually 600° C.-750° C. Flue gas formed by burning coke in the regenerator may be treated to remove particulates and convert carbon monoxide, then flue gas is normally discharged into the atmosphere.

Most FCC units use zeolite-containing catalyst having high activity and selectivity. These catalysts work best when the amount of coke on the catalyst after regeneration is relatively low. It is desirable to regenerate zeolite catalysts to as low a residual carbon level as is possible. It is desirable to burn CO within the regenerator system to conserve heat and to minimize air pollution. Complete CO combustion is now fairly easy to achieve, either by resort to CO combustion promoters or with an FCC regenerator with a dilute phase transport riser.

U.S. Pat. Nos. 4,072,600 and 4,093,535 teach use of combustion-promoting metals such as Pt, Pd, Ir, Rh, Os, Ru and Re in cracking catalysts in concentrations of 0.01 to 50 ppm, based on total catalyst inventory. This approach is so successful that most FCC units use CO combustion promoters. This reduces CO emissions but usually increases nitrogen oxides ($NO_x$) in the regenerator flue gas. It is difficult in a catalyst regenerator to completely burn coke and CO in the regenerator without increasing the $NO_x$ content of the regenerator flue gas.

FCC regenerators such as shown in U.S. Pat. No. 3,948,757, Strother or U.S. Pat. No. 19,221, Castagnos, Jr. et al, burn much of the coke on spent catalyst in a relatively fast fluidized bed coke combustor, then can afterburn much of the produced CO in a dilute phase transport riser superimposed above the coke combustor. The process usually requires some recycle of hot regenerated catalyst to the coke combustor, such as is shown in U.S. Pat. No. 3,926,778, to get the coke combustor hot enough to burn coke rapidly, and in turn to promote CO combustion in the transport riser above the coke combustor.

Most new FCC regenerators are of the high efficiency type, and most of these operate with both catalyst recycle to the coke combustor and with some CO combustion promoter present.

In modern FCC's complete CO combustion is easy to achieve and no longer a problem. Some modifications have been proposed to deal with heavy feeds, such as putting a heat exchanger in the regenerator to remove heat. U.S. Pat. No. 4,578,366 Cetinkaya et al and U.S. Pat. No. 4,425,301 Vickers et al teach a regenerator comprising a coke combustor, a short dilute phase region above it, and a second dense bed where regenerated catalyst is collected for reuse in the process and recycle to the coke combustor. Recycled catalyst passes through a heat exchanger then into the coke combustor. The recycle catalyst flow to the coke combustor and amount of heat removal in the heat exchanger can be controlled based on a temperature at an upper portion of the combustion zone.

Thus it can be seen that the problem of CO emissions has been largely solved in modern FCC regenerators, either by use of CO combustion promoting catalyst or by use of a high efficiency regenerator design or some combination of the two approaches. The selection of process conditions which eliminate CO, and especially the use of CO combustion promoters such as Pt, has worsened the $NO_x$ problem. Tighter $NO_x$ emissions limits have made control of $NO_x$ emissions even more important, and the industries response to this problem will now be reviewed.

PROCESS APPROACHES TO $NO_x$ CONTROL

Process modifications are suggested in U.S. Pat. No. 4,413,573 and U.S. Pat. No. 4,325,833 directed to two- and three-stage FCC regenerators, which reduce $NO_x$ emissions.

U.S. Pat. No. 4,313,848 teaches countercurrent regeneration of spent FCC catalyst, without backmixing, to minimize $NO_x$ emissions.

U.S. Pat. No. 4,309,309 teaches the addition of a vaporizable fuel to the upper portion of a FCC regenerator to minimize $NO_x$ emissions. Oxides of nitrogen formed in the lower portion of the regenerator are reduced in the reducing atmosphere generated by burning fuel in the upper portion of the regenerator.

The approach taken in U.S. Pat. No. 4,542,114 is to minimize flue gas volume by using oxygen rather than air in the FCC regenerator, with consequent reduction in the amount of flue gas produced.

In Green et al, U.S. Pat. No. 4,828,680, which is incorporated herein by reference, the level of $NO_x$ emissions from a fluidized catalytic cracking (FCC) unit was reduced by incorporating carbonaceous particles such as sponge, coke or coal into the circulating inventory of cracking catalyst. The carbonaceous particle performed several functions, selectively absorbing metal contaminants in the feed and also reducing $NO_x$ emissions in certain instances. This approach is well suited to FCC units where large volumes of coal or coke can be easily handled, but some modification of the FCC unit may be necessary, and the reduction in $NO_x$ emissions may not be as great as desired.

Another process approach is to create a relatively reducing atmosphere in some portion of the regenerator by segregating the CO combustion promoter. Reduction of $NO_x$ emissions in FCC regenerators was achieved in U.S. Pat. No. 4,812,430 and U.S. Pat. No. 4,812,431 by using a conventional CO combustion promoter (Pt) on an unconventional support which permitted the support to segregate in the regenerator. Use of large, hollow, floating spheres gave a sharp segregation of CO combustion promoter in the regenerator. Disposing the CO combustion promoter on fines and allowing these fines to segregate near the top of a dense bed or to be selectively recycled into the dilute phase above a dense bed was another way to segregate the CO combustion promoter.

CATALYTIC APPROACHES TO $NO_x$ CONTROL

Recent catalyst patents include U.S. Pat. No. 4,300,997 and its division, U.S. Pat. No. 4,350,615, both directed to the use of Pd-Ru CO-combustion promoter. The bi-metallic CO combustion promoter is reported to do an adequate job of converting CO to $CO_2$, while minimizing the formation of $NO_x$.

Another catalyst development is disclosed in U.S. Pat. No. 4,199,435 which suggests steam treating conventional metallic CO combustion promoter to decrease $NO_x$ formation without impairing too much the CO combustion activity of the promoter.

U.S. Pat. No. 4,235,704 suggests too much CO combustion promoter causes $NO_x$ formation and calls for monitoring the $NO_x$ content of the flue gases and adjusting the concentration of CO combustion promoter in the regenerator based on the amount of $NO_x$ in the flue gas. As an alternative to adding less CO combustion promoter the patentee suggests deactivating it in place by adding something to deactivate the Pt such as lead, antimony, arsenic, tin or bismuth.

All the catalyst and process patents discussed above in the sections devoted to process and catalytic routes to reduction of $NO_x$ emissions are incorporated herein by reference.

STACK GAS TREATMENT

It is also known to react $NO_x$ in flue gas with NH3. NH3 is a very selective reducing agent which does not react rapidly with excess oxygen which may be present in the flue gas. Two types of $NH_3$ process have evolved, thermal and catalytic.

Thermal processes, e.g., the Exxon Thermal $DeNO_x$ process, operate as homogeneous gas-phase processes at very high temperatures, typically around 1550°-1900° F. More details of such a process are disclosed by Lyon, R. K., Int. J. Chem. Kinet., 3, 315, 1976, which is incorporated by reference.

The catalytic systems generally operate at much lower temperatures, typically at 300°-850° F. which are typical of flue gas streams. The catalysts used in these processes are readily fouled, or the process lines plugged, by catalyst fines which are an integral part of FCC regenerator flue gas. U.S. Pat. No. 4,521,389 and U.S. Pat. No. 4,434,147 disclose adding NH3 to $NO_x$ containing flue gas to catalytically reduce the $NO_x$ to nitrogen.

None of the approaches described above provides the perfect solution. Process approaches, such as multistage or countercurrent regenerators, reduce $NO_x$ emissions but require extensive rebuilding of the FCC regenerator.

Various catalytic approaches, e.g., addition of lead or antimony, as taught in U.S. Pat. No. 4,235,704, to degrade the efficiency of the Pt function may help some but still may fail to meet the ever more stringent $NO_x$ emissions limits set by local governing bodies. It is also important, in many FCC units, to maintain the effectiveness of the CO combustion promoter in order to meet CO emissions limits.

Stack gas cleanup methods are powerful, but the capital and operating costs are high.

It seemed there was no easy way to reduce $NO_x$ emissions. It was also puzzling to us why high efficiency regenerators were so much better in regard to $NO_x$ emissions than bubbling, single dense bed regenerators. FCC operators have long known that $NO_x$ emissions were worse in bubbling, single dense bed regenerators than in the more modern, high efficiency regenerators. It has been theorized that the reduced $NO_x$ emissions in the high efficiency regenerator are due in part to the fast fluidized dense bed "coke combustor" where most of the coke combustion occurs. In a fast fluidized bed there are no large bubbles of air, creating highly oxidizing atmospheres which lead to high emissions of $NO_x$. To a lesser extent the reduced $NO_x$ emissions may be due to the somewhat more reducing atmosphere which is characteristic of the dense bed within the coke combustor.

Although the $NO_x$ emissions from high efficiency regenerators are usually significantly less, typically 10-50% less than would be expected from a comparable single, bubbling bed regenerator, the levels of $NO_x$ are still troublesome. It would also be beneficial if dirtier feeds, or more nitrogenous feeds, could be processed in FCC units without exceeding $NO_x$ emissions limits. It was especially important to retain the relative simplicity and complete CO combustion characteristics of high efficiency regenerators. Thus although the approach suggested in U.S. Pat. No. 4,868,144 Herbst et al, which is incorporated herein by reference, would reduce $NO_x$ it would require substantial capital expense and would not permit complete afterburning of CO to CO2 within the regenerator.

In U.S. Pat. No. 4,868,144 staged catalyst regeneration, in a multistage process involving a high efficiency regenerator with a multiple catalyst/flue gas separation means was used, along with unusually low amounts of combustion air, to substantially reduce NOx emissions and hydrothermal deactivation of catalyst. Spent catalyst and hot recycled regenerated catalyst were mixed in a riser mixer beneath and passing into a coke combustor. The riser mixer operated to achieve oxygen lean conditions, so that formation of NOx would be retarded, or if formed would be converted in the riser. The transport riser, which was a sort of pre-regeneration, upstream of the coke combustor of the high efficiency regenerator, would remove much of the "fast coke" or hydrogen rich coke which contributes so much steam to conventional high efficiency regenerators. The residence time in the riser mixer so short, and the operation of the outlet with a restricted oxygen concentration probably severely limits both the amount of coke burning that can be achieved in the riser, and the amount of afterburning of CO to CO2 in the riser mixer. The patent does not report the composition of the flue gas produced by the riser mixer but does report that it is separately withdrawn from the regenerator, primarily to remove steam and minimize hydrothermal deactivation of the catalyst or steaming.

The regenerator added more oxygen in each succeeding stage, but always limiting the amount so that relatively low oxygen concentrations would be present at the outlet to each stage, and always separating the flue gas intermediate each stage of regeneration to remove water of hydration and minimize steaming of the catalyst in a subsequent regeneration stage.

Thus, although the approach outline in U.S. Pat. No. 4,868,144 would do quite a lot (reduce NOx emissions, reduce steaming of catalyst), it would also cost quite a lot to implement, would produce at least one CO containing stream (flue gas from the riser mixer), and would solve a problem that is not too serious at many refineries (FCC units can tolerate existing steaming, usually with catalyst makeup). We wanted a way to reduce NOx emissions without requiring significant modifications to the way high efficiency regenerators run and without creating multiple flue gas streams, some of which would contain so much CO that further treatment to eliminate CO would be necessary.

We studied the way high efficiency regenerators operate and made some simple experiments to see if the already favorable $NO_x$ emissions characteristics of these regenerators could be further improved. We found that operating these units with unusually low amounts of combustion air or with much less recycle of hot regenerated catalyst to the coke combustor, we could achieve a significant, and unexpected, reduction in $NO_x$ emissions. We discovered that downgrading the operation of the coke combustor and/or the dilute phase transport riser could greatly reduce NOx emissions while still achieving complete CO combustion.

BRIEF SUMMARY OF THE INVENTION

Accordingly, the present invention provides in a fluidized catalytic catalytic cracking process wherein a nitrogen containing hydrocarbon feed contacts a source of hot regenerated catalyst in a catalytic cracking reactor means to produce catalytically cracked products and spent catalyst containing coke contaminated with nitrogen compounds, wherein the spent catalyst is stripped in a catalyst stripping means to produce stripped catalyst which is regenerated in a high efficiency regenerator means comprising a fast fluidized bed coke combustor adapted to receive said spent stripped catalyst and a stream of hot regenerated catalyst, a dilute phase transport riser above said coke combustor adapted to transport catalyst and combustion gas as a dilute phase from an upper portion of said coke combustor through said dilute phase transport riser to a vessel comprising a second fluidized bed of catalyst, and a regenerated catalyst recycle means adopted to recycle at least a portion of the resulting regenerated catalyst from said second fluidized bed to said coke combustor and wherein a flue gas comprising nitrogen oxides ($NO_x$) is withdrawn from the regenerator, the improvement comprising at least periodically monitoring the $NO_x$ content of the flue gas or a measured process parameter which is indicative of the $NO_x$ concentration in the regenerator flue gas and adjusting the amount of regenerated catalyst recycle from the second fluidized bed to the coke combustor relative to the amount of spent stripped catalyst added to said coke combustor in response to the direct or indirect measurement of $NO_x$ content of the flue gas.

In another embodiment the present invention provides in a fluidized catalytic cracking process wherein a nitrogen containing hydrocarbon feed contacts a source of hot regenerated catalyst in a catalytic cracking reactor means to produce catalytically cracked products and spent catalyst containing coke contaminated with nitrogen compounds wherein the spent catalyst is stripped in a catalyst stripping means to produce stripped catalyst which is regenerated in a high efficiency regenerator means comprising a fast fluidized bed coke combustor adapted to receive said spent stripped catalyst and a stream of hot regenerated catalyst, a dilute phase transport riser above said coke combustor adapted to transport catalyst and all combustion gas produced in said coke combustor as a dilute phase from an upper portion of said coke combustor through said dilute phase transport riser to a vessel comprising a second fluidized bed of catalyst, and a regenerated catalyst recycle means adopted to recycle at least a portion of the resulting regenerated catalyst from said second fluidized bed to said coke combustor and wherein a single flue gas stream is produced by said catalyst regeneration containing nitrogen oxides ($NO_x$) which single flue gas stream is withdrawn from the regenerator, the improvement comprising continuously analyzing the $NO_x$ content of the flue gas and continuously controlling at least one of catalyst recirculation from the second fluidized bed to the coke combustor and the amount of combustion gas added to control the $NO_x$ content of the flue gas.

In an apparatus embodiment, the present invention provides an apparatus for the fluidized catalytic cracking of a nitrogen containing hydrocarbon feed comprising: a riser cracking catalytic cracking reactor means having a base portion and a top portion, said base portion adaptive to receive a supply of hot regenerated cracking catalyst and a supply of nitrogen containing feed, and wherein said cracking reactor means produces catalytically cracked products and spent catalyst containing coke contaminated with nitrogen compounds which are discharged from an upper portion of said riser reactor, a cracked product and spent catalyst separation means adaptive to separate cracked product and spent catalyst discharged from said riser reactor into a cracked product vapor phase stream which is removed from said reactor and a spent catalyst stream, a spent catalyst stripping means adaptive to accept spent catalyst from said separation means and to strip said spent catalyst by contact with a stripping gas to produce stripped catalyst, a high efficiency catalyst regeneration means adaptive to accept stripped catalyst from said stripping means and produce regenerated catalyst which is recycled to said riser cracking reactor means comprising in cooperative combination a coke combustor, adaptive to accept said stripped catalyst, an oxygen containing regeneration gas stream, and a recycled stream of hot regenerated catalyst, maintaining them as a fast fluidized bed a dilute phase transport riser connective with and above said coke combustor adapted to transport catalyst and combustion gas in a dilute phase from an upper portion of the fast fluidized bed of said coke combustor through said dilute phase transport riser to a dilute phase transport riser outlet within a vessel, a vessel containing said dilute phase transport riser outlet, said vessel comprising means to separate regenerated catalyst and flue gas comprising $NO_x$ discharged from said dilute phase transport riser into a flue gas dilute phase and a regenerated catalyst phase which is maintained as a bubbling fluidized bed of catalyst within said vessel, a regenerated catalyst withdrawal means adaptive to remove regenerated catalyst from said bubbling fluidized bed and transport regenerated catalyst to said riser cracking reactor means, and a regenerated catalyst recycle means comprising catalyst recycle means and catalyst flow control means means adopted to recycle at least a portion of the regenerated catalyst from said bubbling fluidized bed in said vessel to said coke combustor, characterized in that a flue gas nitrogen oxides ($NO_x$) emissions measurement and control means is provided adaptive to control at least one of the combustion air rate and the amount of catalyst recirculation from the bubbling fluidized bed to the coke combustor in response to a signal generated by said $NO_x$ emissions measurement and control means.

DETAILED DESCRIPTION

Figure 1:
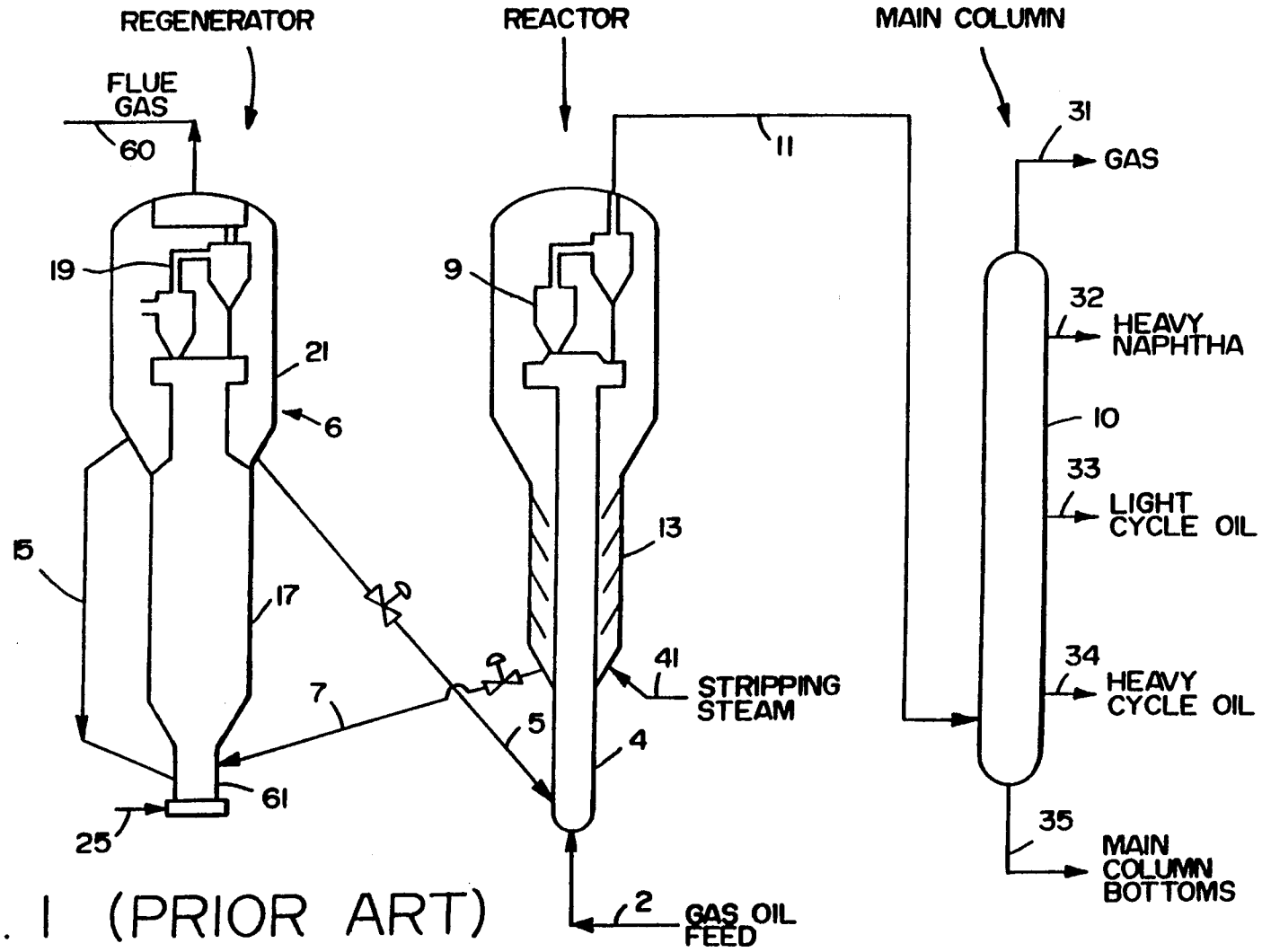
FIG. 1 (PRIOR ART)
FIG. 1 (prior art) shows a high efficiency regenerator with a coke combustor, transport riser, and second fluidized bed of regenerated catalyst.

The present invention is an improvement for use in any catalytic cracking unit which uses a high efficiency catalyst regenerator. Although changes in regenerator operation make the present invention work, the regenerator should be considered in relation to the entire cracking process. Accordingly, the essential elements of the FCC process, ranging from the feed to the reactor and the catalysts used, will be reviewed. After this review, the conventional and improved method of operating the FCC high efficiency FCC regenerator will be reviewed, in conjunction with a review of the Figures.

FCC FEED

Any conventional FCC feed can be used. The process of the present invention is useful for processing nitrogenous charge stocks, those containing more than 500 ppm total nitrogen compounds, and especially useful in processing stocks containing very high levels of nitrogen compounds, such as those with more than 1000 wt ppm total nitrogen compounds.

The feeds may range from the typical, such as petroleum distillates or residual stocks, either virgin or partially refined, to the atypical, such as coal oils and shale oils. The feed frequently will contain recycled hydrocarbons, such as light and heavy cycle oils which have already been subjected to cracking.

Preferred feeds are gas oils, vacuum gas oils, atmospheric resids, and vacuum resids. The present invention is most useful with feeds having an initial boiling point above about 650° F.

FCC CATALYST

Any commercially available FCC catalyst may be used. The catalyst can be 100% amorphous, but preferably includes some clay, or the like. The zeolite is usually 5–40 wt % of the catalyst, with the rest matrix. Conventional zeolites such as X and Y zeolites, dealuminized Y (DEAL Y), ultrastable Y (USY) and ultrahydrophobic Y (UHP Y) zeolites may be used. The zeolites may be stabilized with Rare Earths, e.g., 0.1 to 10 wt % RE.

Relatively high silica zeolite containing catalysts are preferred for use in the present invention. They withstand the high temperatures usually associated with complete combustion of CO to $CO_2$ within the FCC regenerator. Catalysts containing 10–40% USY or rare earth USY (REUSY) are especially preferred.

The catalyst inventory may also contain one or more additives, either present as separate additive particles or mixed in with each particle of the cracking catalyst. Additives can be added to enhance octane (medium pore size zeolites, sometimes referred to as shape selective zeolites, i.e., those having a Constraint Index of 1–12 and typified by ZSM-5, and other materials having a similar crystal structure).

CO combustion additives are available from most FCC catalyst vendors.

The FCC catalyst composition, per se, forms no part of the present invention.

CO COMBUSTION PROMOTER

Use of a CO combustion promoter in the regenerator or combustion zone is not essential for the practice of the present invention; however, it is preferred. These materials are well-known.

U.S. Pat. No. 4,072,600 and U.S. Pat. No. 4,235,754, which are incorporated by reference, disclose operation of an FCC regenerator with minute quantities of a CO combustion promoter. From 0.01 to 100 ppm Pt metal or enough other metal to give the same CO oxidation may be used with good results. Very good results are obtained with as little as 0.1 to 10 wt. ppm platinum present on the catalyst in the unit.

SOx ADDITIVES

Additives may be used to adsorb SOx. These are believed to be primarily various forms of alumina, containing minor amounts of Pt, on the order of 0.1 to 2 ppm Pt.

Good additives for removal of SOx are available from several catalyst suppliers, such as Davison's "R" or Katalistiks International, Inc.'s "DESOX."

The process of the present invention is believed to work fairly well with these additives, although the effectiveness of the SOx additives may be reduced somewhat by the somewhat more reducing atmosphere in much of the high efficiency regenerator which is a by-product of our invention.

FCC REACTOR CONDITIONS

Conventional riser cracking conditions may be used. Typical riser cracking reaction conditions include catalyst/oil ratios of 0.5:1 to 15:1 and preferably 3:1 to 8:1, and a catalyst contact time of 0.1–50 seconds, and preferably 0.5 to 10 seconds, and most preferably about 2 to 6 seconds, and riser top temperatures of 900° to about 1050° F.

It is important to have good mixing of feed with catalyst in the base of the riser reactor, using conventional techniques such as adding large amounts of atomizing steam, use of multiple nozzles, use of atomizing nozzles and similar technology.

It is preferred, but not essential, to have a riser catalyst acceleration zone in the base of the riser.

It is preferred, but not essential, to have the riser reactor discharge into a closed cyclone system for rapid and efficient separation of cracked products from spent catalyst. A preferred closed cyclone system is disclosed in U.S. Pat. No. 4,502,947 to Haddad et al, which is incorporated by reference.

It is preferred but not essential, to rapidly strip the catalyst just as it exits the riser, and upstream of the conventional catalyst stripper. Stripper cyclones disclosed in U.S. Pat. No. 4,173,527, Schatz and Heffley, which is incorporated herein by reference, may be used.

It is preferred, but not essential, to use a hot catalyst stripper. Hot strippers heat spent catalyst by adding some hot, regenerated catalyst to spent catalyst. Suitable hot stripper designs are shown in U.S. Pat. No. 3,821,103, Owen et al, which is incorporated herein by reference. If hot stripping is used, a catalyst cooler may be used to cool the heated catalyst before it is sent to the catalyst regenerator. A preferred hot stripper and catalyst cooler is shown in U.S. Pat. No. 4,820,404, Owen, which is incorporated by reference.

The FCC reactor and stripper conditions, per se, can be conventional.

CATALYST REGENERATION

The process and apparatus of the present invention improve the operation of conventional high efficiency FCC regenerators. The essential elements of a high efficiency regenerator include a coke combustor, a dilute phase transport riser and a second dense bed. Preferably, a riser mixer is used. These regenerators are widely known and used.

A typical high efficiency FCC regenerator is shown in U.S. Pat. No. 3,926,778, which is incorporated herein by reference.

DETAILED DESCRIPTION OF DRAWINGS

The invention can be better understood with reference to the drawings. FIG. 1 will first be discussed, it is, as far as hardware goes, a typical, prior art, all riser cracking FCC unit with a high efficiency FCC regenerator. All the FCC hardware shown is conventional.

A heavy feed, typically a gas oil boiling range material, is charged via line 2 to mix with hot regenerated catalyst added via conduit 5 to the riser. Preferably, some atomizing steam is added, by means not shown, to the base of the riser, usually with the feed. With heavier feeds, e. g., a resid, 2–10 wt. % steam may be used. The heavy hydrocarbon feed and catalyst mixture rises as a generally dilute phase through riser 4. The cracked products and coked catalyst are discharged from the riser. Cracked products pass through two stages of cyclone separation shown generally as 9 in FIG. 1.

The riser 4 top temperature usually ranges between about 480° and 615° C. (900° and 1150° F.), and preferably between about 538° and 595° C. (1000° and 1050° F). The riser top temperature is usually controlled by adjusting the catalyst to oil ratio in riser 4 or by varying feed preheat.

Cracked products are removed from the FCC reactor via transfer line 11 and charged to the base of the main column 10. In some refineries, this column would be called the Syncrude column, because the catalytic cracking process has created a material with a broad boiling range, something like a synthetic crude oil. The main column 10 recovers various product fractions, from a heavy material such as main column bottoms, withdrawn via line 35, to normally gaseous materials, such as the vapor stream removed overhead via line 31 from the top of the column. Intermediate fractions include a heavy cycle oil fraction in line 34, a light cycle oil in line 33, and one or more gasoline boiling range fractions in line 32. Much of the reformate will be removed as a gasoline boiling range material in line 32. It is possible to provide multiple naphtha withdrawal points, e.g., a light naphtha and a heavy naphtha, or a single naphtha fraction may be sent to a splitter column to produce one or more naphtha boiling range fractions. These product recovery and fractionation steps are all conventional.

In the reactor vessel cyclones 9 separate most of the catalyst from the cracked products and discharge this catalyst down via diplegs to a stripping zone 13 located in a lower portion of the FCC reactor. Stripping steam is added via line 41 to recover adsorbed and/or entrained hydrocarbons from catalyst. Stripped catalyst is removed via line 7 and charged to a high efficiency regenerator 6. A relatively short riser-mixer section 61 is used to mix spent catalyst from line 7 with hot, regenerated catalyst from line 15 and combustion air added via line 25. The riser mixer discharges into coke combustor 17. Regenerated catalyst is discharged from an upper portion of the dilute phase transport riser above the coke combustor. Hot regenerated catalyst collects in upper vessel 21 as a dense phase fluidized bed, and some of it is recycled via line 15 to the riser mixer, while some is recycled via line 5 to crack the fresh feed in the riser reactor 4. Several stages of cyclone separation are used to separate flue gas, removed via line 60. The catalyst regeneration sequence is conventional.

Figure 2:
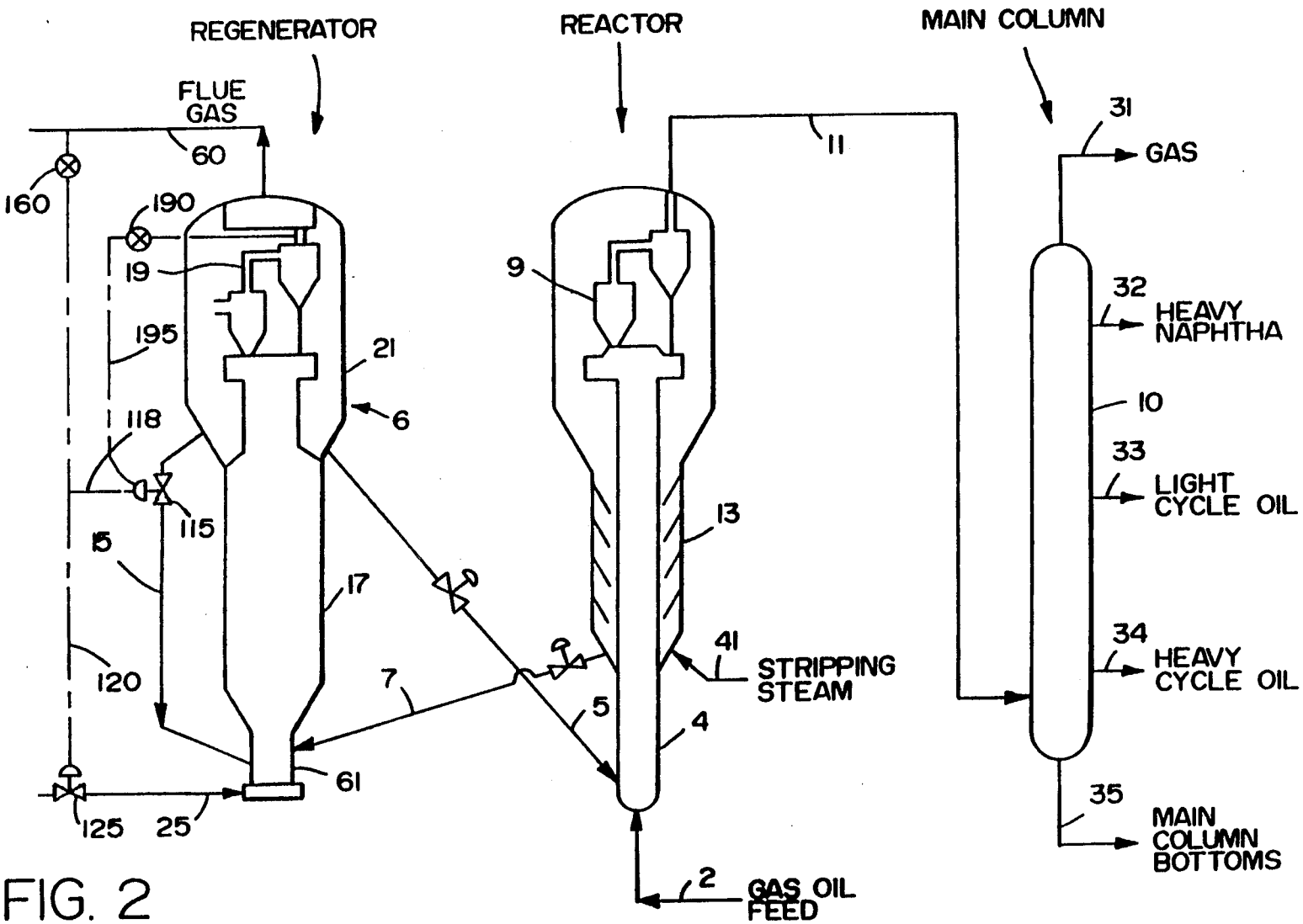
FIG. 2 (invention) shows use of an NOx analyzer controller to regulate catalyst recycle and/or combustion air to the coke combustor.

A preferred embodiment of the present invention will now be described with reference to FIG. 2.

As in the FIG. 1 embodiment, a heavy feed, typically a gas oil boiling range material, and steam are charged via line 2 to the base of riser 4. The reactor and product recovery sections are the same, and will not be discussed. What is different in the FIG. 2 embodiment is the use of a NOx analyzer controller 160 in the flue gas line 60. Controller 160 develops a signal indicative of the amount of NOx in the flue gas and transmits this signal via signal transmission means 118 or means 120 to valves 115 and 125 respectively. Valve 115 regulates the flow of hot regenerated catalyst from the second fluidized bed region of regenerator 6 to the base of the coke combustor 17. Valve 125 regulates the amount of combustion air added to the coke combustor 17. Temperature indicator controller 190, sensing a cyclone temperature indicative of dilute phase afterburning, is provided as a safety measure to allow a signal to be sent via signal transmissions means 195 to catalyst recirculation valve 115 to allow an increase in catalyst recirculation if flue gas temperatures get too high. This will increase the amount of coke combustion that occurs in the coke combustor and increase the amount of CO combustion occurring in the dilute phase transport riser and force the unit to an operation more like that of conventional high efficiency regenerators.

CONTROL OF CATALYST RECYCLE

Although the exact mechanism by which a reduction in catalyst recirculation to the coke combustor brings about a reduction in $NO_x$ emissions is not understood, the following theory is offered.

To reduce $NO_x$ in an FCC regenerator, it is essential to have either a reducing atmosphere or the presence of carbonaceous material to react with $NO_x$ formed during coke combustion. The principal of reacting $NO_x$ with carbonaceous particles in an FCC regenerator is not per se novel—Green and Yan, developed this concept and reported on it in U.S. Pat. No. 4,828,680, which is incorporated herein by reference.

We believe that it is essential to have a certain minimum amount of carbonaceous particles and/or a reducing atmosphere within some portion of the coke combustor and/or transport riser. In this way, the reducing environment necessary to eliminate $NO_x$ will be present in the coke combustor and, perhaps, present in some portion of the transport riser as well.

Most FCC operators operate with extremely large amounts of catalyst recycle. Catalyst recycle from the second dense bed to the coke combustor ensures smooth operation. Temperatures within the coke combustor will always be fairly high, a temperature approaching that of the catalyst in the second dense bed. By recycling massive, and we believe unnecessary, amounts of hot regenerated catalyst to the coke combustor, the coke combustor no longer is a reservoir of carbonaceous rich material. In fact, the majority of the material present in the coke combustor is hot regenerated catalyst. Most FCC operators add an amount of hot regenerated catalyst to the coke combustor which equal to, and usually three times as much as, the amount of spent catalyst added to the coke combustor.

Most FCC operators have very expensive, hydraulic slide valves available which permit fine and continuous control of the amount of regenerator catalyst added to the coke combustor. So far as is known, these valves have never been used to control $NO_x$ emissions. In most units the slide valve is opened a sufficient amount, typically to recycle three tons of regenerated catalyst for every ton of spent catalyst to ensure stable operation, and then never touched. In many refineries, the FCC regenerator operates for months without any change of catalyst recycle rate. In some refineries, with a particulates emissions problem, the amount of catalyst recycle would be reduced to help reduce fines in flue gas.

Only one unit, so far as is known, has ever operated without any catalyst recycle, and it is believed that the operation of this unit was made much more stable and much improved by catalyst recycle.

THE DELTA T ANALOGY

It is believed that the process of the present invention allows refiners to have as much control over $NO_x$ emissions as operators of prior art FCC regenerators had of CO emissions from single, dense bed regenerators. This can best be understood by briefly reviewing the way prior art bubbling bed regenerators were controlled to minimize afterburning.

When FCC regenerators were first developed, complete CO combustion was not thought possible. Refiners feared greatly CO combustion in the dilute phase region above the bubbling dense phase fluidized bed of catalyst and developed several control methods to limit afterburning and cause formation of large amounts of CO (which was usually burned in a downstream CO boiler). Early FCC regenerators did not achieve complete combustion of CO to $CO_2$ and generally produced flue gas comprising roughly 50/50 mole percent of CO and $CO_2$. Refiners were limited in the amount of oxygen that they were able to add, because addition of too much oxygen would result in afterburning in the dilute phase base of the regenerator. A simple control scheme was developed by Pohlenz, whereby the amount of air added to the regenerator was controlled by the differential temperature between the dense bed and the dilute phase. It was a simple but direct way of controlling air addition. It allowed a small but controllable amount of after burning to start, typically 50°-100° F., and then adjusted air flow to hold this Delta T. Later workers held the air rate constant and changed the fresh feed rate to increase coke production to the maximum amount that could be burned in the regenerator without afterburning.

In the present invention, control of the amount of catalyst recycle is believed to provide a similar, relatively direct method of controlling the oxidizing/reducing atmosphere within the coke combustor and/or dilute phase transport riser. This control allows refiners, for their first time, to monitor $NO_x$ emissions in the flue gas and reduce them by reducing the amount of catalyst recycle. Although $NO_x$ emissions can be monitored and used to directly control the amount of catalyst recycle, it is also possible, and may be desirable in many instances, to measure some other process variables of the FCC process. Such indirect methods of control may include measuring the oxidizing or reducing atmospheres in the coke combustor or at various elevations within the coke combustor or in the flue gas, periodic sampling of catalyst withdrawn from the coke combustor or the dilute phase transport riser, control of the Delta T in the dilute phase transport riser, or any equivalent means.

The adjustment in flow rate of hot regenerated catalyst to the coke combustor is preferably continuous, but in many FCC units this will not be necessary or desirable. In units which operate with a fairly steady feed rate and feed composition, it may be necessary to make periodic adjustment to catalyst recycle in response to periodic measurement of only $NO_x$ or some plant process variable indicative or predictive of $NO_x$ emissions, such as riser Delta T, once every hour, once a shift, once a day, or weekly or monthly.

The upper and lower limits on catalyst circulation are as follows. The maximum catalyst circulation will usually be set by $NO_x$ or particulates emissions. Most units operate with extremely large amounts of catalyst recirculation, many with more than three tons of recycled catalyst per ton of spent catalyst added to the coke combustor.

From an $NO_x$ emissions standpoint, it is believed that the less catalyst circulation that occurs, the better. High efficiency regenerators do not run too well with no catalyst circulation, so the minimum catalyst circulation will usually be determined at each unit. One sign of too low a catalyst circulation rate will be too low a rate of coke burning in the coke combustor, as evidenced by increasing carbon levels on regenerated catalyst. Another indication of insufficient catalyst circulation is excessive after burning in the dilute phase transport riser (which is tolerable by the process, because the catalyst in the transport riser will act as a heat sink) or excessive afterburning in the dilute phase above the second dense bed (which may damage the cyclones). After burning which occurs here can lead to extremely high temperatures in cyclones above the second dense bed.

The preferred amount of catalyst recirculation will probably change with every significant change in unit operation, i.e., any change in feed rate, feed type, conversion desired, etc. As an extreme example, if the feed rate to the FCC is cut in half, the spent catalyst flow will be cut roughly in half, and residence time of catalyst in the coke combustor will roughly double. It may be necessary to drastically reduce catalyst recirculation, not only reducing it below the 50% which might seem to be required by the reduction in spent catalyst flow, but to further reduce it so that the operation of the coke combustor will be downgraded enough so that sufficient carbon and reducing gases will be present in the coke combustor and/or dilute phase transport riser to react with $NO_x$. It is difficult to quantify all of the changes that occur in FCC units, but the process of the present invention allows the behavior of the high efficiency regenerator to be changed to minimize $NO_x$ emissions regardless of the way the unit is being operated.

EXPERIMENT

The concept was tested by adjusting catalyst recirculation from the second dense bed to the coke combustor in a commercial, high efficiency regenerator at varying air addition rates. The unit did not contain any method of directly measuring catalyst flow, but it was possible to estimate catalyst flows fairly accurately based on the position of the slide valve used to control flow of hot regenerated catalyst to the coke combustor.

The base conditions (prior art) were operation of the unit with a spent catalyst flow of about 22 tons per minute (TPM), which entered the coke combustor at a temperature of about 1000° F. Combustion air was added to the coke combustor in an amount sufficient to burn the desired amount of coke from the catalyst. Air flow was generally controlled to hold a certain amount of excess oxygen, typically 0.5 to 1.0 mole % oxygen in the flue gas from the unit. The unit operated with essentially complete combustion of CO in the coke combustor and/or transport riser. The unit is a little unusual in operating with complete CO combustion with such low levels of oxygen in the flue gas. Most FCC regenerators operating with complete CO combustion require more air and typically operate with 1 or 2% air. The test flue gas oxygen concentration ranged from 0.2 to 0.8 mole %, i.e., from something arguable within the limits of normal commercial operation to an oxygen concentration well below anything practiced commercially, 0.2 mole %.

The amount of hot regenerated catalyst recycled to the coke combustor from the second dense bed or bubbling dense bed of catalyst was usually constant and usually set to recycle more hot regenerated catalyst than spent. In this way the unit always had a relatively hot coke combustor, typically operating at 1250° F., which promoted vigorous carbon burning and rapid afterburning. It is believed that most, if not all, high efficiency regenerators operate with relatively large amounts of catalyst recycle, to make the unit easier to operate. The amount of catalyst recycle would normally be reduced or changed only if there were problems with the opacity of the flue gas. In normal operation the amount of catalyst recirculation to the coke combustor remained constant even though the spent catalyst flow would change slightly. If there was a significant change in feed rate or feed type, the slide valve controlling catalyst recirculation to the coke combustor might be altered, but usually it was kept constant.

As is the case in most FCC units, the unit was constantly changing to adjust to changes in feed rate, crude, or product slate desired. Usually the catalyst recirculation rate was not changed until we decided to determine the effect of catalyst recycle to the coke combustor on $NO_x$ emissions. We ran the tests at several sets of conditions, varying both the amount of catalyst recycle and the amount of excess oxygen in the flue gas.

Catalyst recycle rates ranged from a low of about 22 TPM (when the slide valve was 42% open) to about 30 TPM (when the valve was 58% open). We ran a few tests at a mid point or the transition point between maximum (58% open) and minimum (42% open) positions of the slide valve. The transition catalyst flow was probably about 26 or 27 TPM. In every case the catalyst flow had a marked influence on $NO_x$ emissions with an increase in catalyst flow increasing $NO_x$ emissions.

Figure 3:
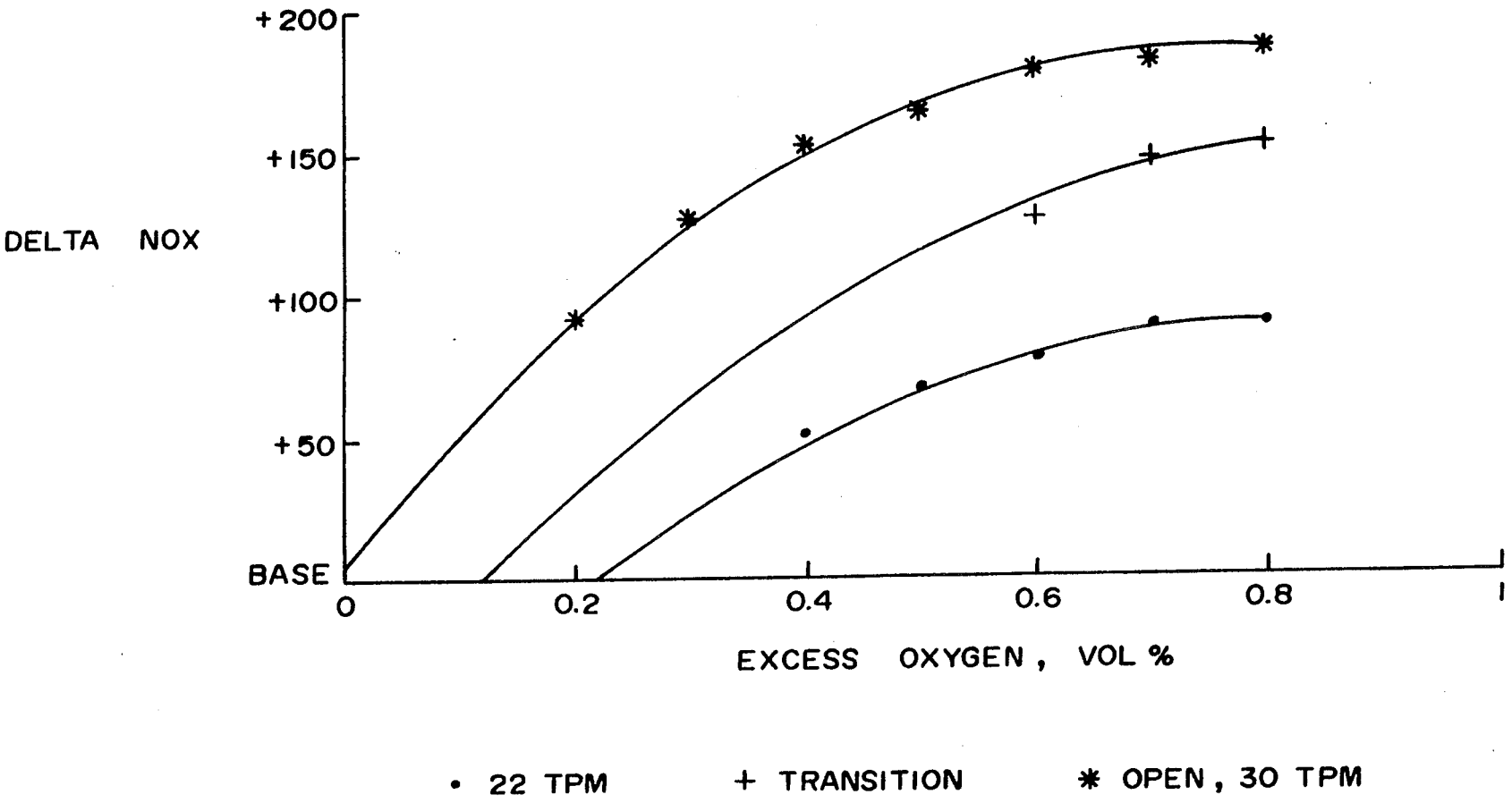
FIG. 3 (invention) shows how the relative amounts of catalyst recycle and combustor air addition changed the NOx content of flue gas from a high efficiency regenerator.

Data are reported in FIG. 3.

The data imply the unit would run best, re. $NO_x$ emissions, if there were no catalyst recycle at all. This is true in regard to $NO_x$ emissions but ignores the fact that the unit would not run well without catalyst recycle to heat the spent catalyst coming into the coke combustor. The data show that high efficiency regenerators are sensitive to catalyst recirculation, in regard to $NO_x$ emissions, and that significant changes in $NO_x$ emissions occur when either excess air or catalyst recirculation are altered.

We realized that $NO_x$ emissions could be greatly reduced and, more importantly, controlled by a distinctly uncomfortable operation, i.e., running the unit with just enough excess oxygen in the flue gas to meet CO emissions and then controlling catalyst recirculation to the coke combustor to control NOx emissions. In this way the regenerator just barely did its job of regenerating the catalyst while maintaining complete CO combustion and while minimizing $NO_x$ emissions. The key to successful operation is controlling catalyst recycle so that $NO_x$ emissions are reduced.

Several control schemes are possible. All require closer monitoring of the unit than has heretofore been practiced. All require operating the unit in a region that is "uncomfortable", i.e., operation with either less air or less catalyst recycle than was considered acceptable for stable operation. Several control options will be reviewed.

I - Fixed Air - Variable Catalyst Recycle

II - Variable Air - Variable Catalyst Recycle

Option I involves operation with fixed air (either constant air, somewhat in excess or a constant % oxygen in flue gas) and variable catalyst recycle in response to an $NO_x$ analyzer controller in the flue gas. An increase in $NO_x$ emissions will call for a decrease in catalyst recycle to the coke combustor. When $NO_x$ emissions abate, the amount of catalyst recycled to the coke combustor will again be increased.

Although the exact mechanism by which reduced catalyst circulation reduces $NO_x$ is not understood, it is probably that the reduced circulation cools off the coke combustor some, resulting in less efficient coke burning. The catalyst leaving the coke combustor will have higher levels of coke on catalyst. There may be more CO present in the coke combustor or present or formed in the dilute phase transport riser, which reacts with the $NO_x$ formed by coke combustion. It is also possible that the increased carbon levels in the coke combustor or, perhaps, even in the transport riser, act in some way to suppress $NO_x$ formation or to promote some reaction of $NO_x$ with carbon. Although the reaction mechanism is not understood, the experiments show that $NO_x$ emissions can be reduced by reducing catalyst recycle to the coke combustor, so our process can be readily implemented by refiners, even if why it works is not understood.

Option II Variable Air - Variable Catalyst Recycle

Option II provides more flexibility and is preferred, but requires a more complex control method. In this mode both the air rate (i.e., the mole % oxygen in the flue gas) and the catalyst recycle to the coke combustor are varied to control $NO_x$ emissions. This method is especially powerful in that refiners can move on both the X and Y axis of the graph (of $NO_x$ emissions v. Cat Recirculation) to control $NO_x$ and optimize regenerator operation.

It should be noted that the Figure showing relative $NO_x$ emissions can not be used directly to predict absolute $NO_x$ emissions at other units or even on the commercial unit used to generate the data. The amount of CO combustion promoter, e.g., Pt on alumina, or cracking catalyst with Pt, will profoundly change a given unit's response to catalyst recirculation and to excess air. Operation with excess amounts of Pt present, e.g., 10 ppm Pt on an elemental metal basis, will probably greatly increase the amount of $NO_x$ present in the flue gas. Directionally the changes shown in the Figure will be the same, i.e., an increase in flue gas oxygen or in catalyst recirculation will still increase $NO_x$ emissions, but the curves will have a different shape.

All control options preferably have a loop, which ensures relatively complete CO combustion. This preferably is done by a direct analysis of flue gas for CO, or less directly by analyzing for oxygen, or by an indirect means, such as the temperature of the cyclones or the flue gas, or a differential temperature indicative of afterburning in the flue gas. All high efficiency regenerators have thermocouples showing temperature in the flue gas and or cyclones above the second dense bed, and these thermocouples can be used to generate a signal indicative of afterburning. A little afterburning is good—it means that the unit is just barely completing the combustion of CO in the transport riser and above the second dense bed. Large amounts of afterburning are bad—CO may escape into the flue gas and the high temperatures associated with burning CO when large amounts of catalyst are not present to act as a heat sink may damage equipment. The unit will run best, in regards to both CO and $NO_x$, when the coke combustor's efficiency is downgraded enough so that the unit just barely makes the limit on CO emissions.

We claim:

1. In a fluidized catalytic cracking process wherein a nitrogen containing hydrocarbon feed contacts a source of hot regenerated catalyst in a catalytic cracking reactor means to produce catalytically cracked products and spent catalyst containing coke contaminated with nitrogen compounds, wherein the spent catalyst is stripped in a catalyst stripping means to produce stripped catalyst which is regenerated in a high efficiency regenerator means comprising a fast fluidized bed coke combustor adapted to receive said spent stripped catalyst and a stream of hot regenerated catalyst, a dilute phase transport riser above said coke combustor adapted to transport catalyst and combustion gas as a dilute phase from an upper portion of said coke combustor through said dilute phase transport riser to a vessel comprising a second fluidized bed of catalyst, and a regenerated catalyst recycle means adopted to recycle at least a portion of the resulting regenerated catalyst from said second fluidized bed to said coke combustor, and wherein a flue gas comprising nitrogen oxides ($NO_x$) is withdrawn from the regenerator, the improvement comprising at least periodically monitoring the $NO_x$ content of the flue gas, and adjusting the amount of regenerated catalyst recycle from the second fluidized bed to the coke combustor relative to the amount of spent stripped catalyst added to said coke combustor in response to the direct measurement of $NO_x$ content of the flue gas.

2. In a fluidized catalytic cracking process wherein a nitrogen containing hydrocarbon feed contacts a source of hot regenerated catalyst in a catalytic cracking reactor means to produce catalytically cracked products and spent catalyst containing coke contaminated with nitrogen compounds, wherein the spent catalyst is stripped in a catalyst stripping means to produce stripped catalyst which is regenerated by contact with a regeneration gas comprising oxygen in a high efficiency regenerator means comprising a fast fluidized bed coke combustor adapted to receive said spent stripped catalyst and a stream of hot regenerated catalyst, a dilute phase transport riser above said coke combustor adapted to transport catalyst and combustion gas as a dilute phase from an upper portion of said coke combustor through said dilute phase transport riser to a vessel comprising a second fluidized bed of catalyst, and a regenerated catalyst recycle means adopted to recycle at least a portion of the resulting regenerated catalyst from said second fluidized bed to said coke combustor, and wherein a flue gas comprising oxygen and nitrogen oxides ($NO_x$) is withdrawn from the regenerator, the improvement comprising limiting the amount of combustion gas added to maintain less than 1.0 mole % oxygen in the flue gas and at least periodically monitoring the $NO_x$ content of the flue gas, and adjusting the amount of regenerated catalyst recycle from the second fluidized bed to the coke combustor relative to the amount of spent stripped catalyst added to said coke combustor and the amount of combustion gas added to said coke combustor and said transport riser in response to the direct measurement of $NO_x$ content of the flue gas.

3. A fluidized catalytic cracking process wherein a nitrogen containing hydrocarbon feed contacts a source of hot regenerated catalyst in a catalytic cracking reactor means to produce catalytically cracked products and spent catalyst containing coke contaminated with nitrogen compounds, wherein the spent catalyst is stripped in a catalyst stripping means to produce stripped catalyst which is regenerated by contact with a regeneration gas comprising oxygen in a high efficiency regenerator means comprising a fast fluidized bed coke combustor adapted to receive said spent stripped catalyst and a stream of hot regenerated catalyst, a dilute phase transport riser above said coke combustor adapted to transport catalyst and all combustion gas added to said coke combustor through said dilute phase transport riser to a vessel comprising a second fluidized bed of catalyst, and a regenerated catalyst recycle means adopted to recycle at least a portion of the resulting regenerated catalyst from said second fluidized bed to said coke combustor, and wherein a flue gas comprising oxygen and nitrogen oxides ($NO_x$) is withdrawn from the regenerator, characterized by limiting the amount of combustion gas added to said coke combustor to produce a flue gas with less than 1.0 moles % O2 and at least periodically monitoring the $NO_x$ content of the flue gas, and adjusting both the amount of combustion gas added to the coke combustor and the amount of catalyst recirculation from the second fluidized bed to the coke combustor in response to the direction measurement of $NO_x$ content of the flue gas.

4. An apparatus for the fluidized catalytic cracking of a nitrogen containing hydrocarbon feed comprising:

a) a riser cracking catalytic cracking reactor means having a base portion and a top portion, said base portion adaptive to receive a supply of hot regenerated cracking catalyst and a supply of nitrogen containing feed, and wherein said cracking reactor means produces catalytically cracked products and spent catalyst containing coke contaminated with nitrogen compounds which are discharged from an upper portion of said riser reactor, b) a cracked product and spent catalyst separation means adaptive to separate cracked product and spent catalyst discharged from said riser reactor into a cracked product vapor phase stream which is removed from said reactor and a spent catalyst stream, c) a spent catalyst stripping means adaptive to accept spent catalyst from said separation means and to strip said spent catalyst by contact with a stripping gas to produce stripped catalyst, d) a high efficiency catalyst regeneration means adaptive to accept stripped catalyst from said stripping means and produce regenerated catalyst which is recycled to said riser cracking reactor means comprising in cooperative combination:

a coke combustor adaptive to accept said stripped catalyst, an oxygen containing regeneration gas stream, and a recycled stream of hot regenerated catalyst, maintaining them as a fast fluidized bed;

a dilute phase transport riser connective with and above said coke combustor adapted to transport catalyst and combustion gas in a dilute phase from an upper portion of the fast fluidized bed of said coke combustor through said dilute phase transport riser to a dilute phase transport riser outlet within a vessel;

a vessel containing said dilute phase transport riser outlet, said vessel comprising means to separate regenerated catalyst and flue gas comprising $NO_x$ discharged from said dilute phase transport riser into a flue gas dilute phase and a regenerated catalyst phase which is maintained as a bubbling fluidized bed of catalyst within said vessel, a regenerated catalyst withdrawal means adaptive to remove regenerated catalyst from said bubbling fluidized bed and transport regenerated catalyst to said riser cracking reactor means, and a regenerated catalyst recycle means comprising catalyst recycle means and catalyst flow control means means adopted to recycle at least a portion of the regenerated catalyst from said bubbling fluidized bed in said vessel to said coke combustor;

characterized in that a flue gas nitrogen oxides ($NO_x$) emissions measurement and control means is provided adaptive to control the amount of catalyst recirculation from the bubbling fluidized bed to the coke combustor in response to a signal generated by said $NO_x$ emissions measurement and control means.

* * * * *